US007628111B2

(12) United States Patent
Richmond

(10) Patent No.: US 7,628,111 B2
(45) Date of Patent: Dec. 8, 2009

(54) TEMPERATURE CONTROLLED RAILWAY CAR SUPPORT POST

(75) Inventor: Shaun Richmond, Frankfort, IL (US)

(73) Assignee: Trinity Industries, Inc., Dallas, TX (US)

( * ) Notice: Subject to any disclaimer, the term of this patent is extended or adjusted under 35 U.S.C. 154(b) by 217 days.

(21) Appl. No.: 11/761,181

(22) Filed: Jun. 11, 2007

(65) Prior Publication Data

US 2008/0302266 A1 Dec. 11, 2008

(51) Int. Cl.
*B61D 17/00* (2006.01)
*E04C 3/00* (2006.01)

(52) U.S. Cl. ..... 105/404; 52/841

(58) Field of Classification Search ..... 105/396, 105/401, 404, 409; 296/186.1, 181.2; 52/837, 52/838, 841; 238/57
See application file for complete search history.

(56) References Cited

U.S. PATENT DOCUMENTS 4,291,081 A * 9/1981 Olez ..... 428/119
5,388,527 A * 2/1995 Thornton ..... 104/284
6,173,550 B1 * 1/2001 Tingley ..... 52/837
6,256,958 B1 * 7/2001 Matthews ..... 52/489.2
6,561,736 B1 * 5/2003 Doleshal ..... 405/251
6,575,102 B2 * 6/2003 Norton et al. ..... 105/423
6,735,919 B1 * 5/2004 diGirolamo et al. ..... 52/838
6,941,875 B2 * 9/2005 Norton et al. ..... 105/397
6,986,205 B2 * 1/2006 Vrana ..... 29/897.3
7,228,805 B2 * 6/2007 Beers et al. ..... 105/423
2005/0178285 A1 * 8/2005 Beers et al. ..... 105/404
2005/0268815 A1 * 12/2005 Creighton et al. ..... 105/404
2006/0065152 A1 * 3/2006 Heitmeyer et al. ..... 105/404
2007/0234927 A1 * 10/2007 Beers et al. ..... 105/404
2008/0302266 A1 * 12/2008 Richmond ..... 105/404

* cited by examiner

*Primary Examiner*—S. Joseph Morano
*Assistant Examiner*—Jason C Smith
(74) *Attorney, Agent, or Firm*—Baker Botts L.L.P.

(57) ABSTRACT

A railcar system includes a plurality of railcar walls and a plurality of railcar support posts each coupled to at least one of the plurality of walls. Each of the plurality of support posts comprises a web portion comprising a non-metallic material and a plurality of flange portions coupled to the web portion, the flange portions comprising a metallic material.

29 Claims, 1 Drawing Sheet

TEMPERATURE CONTROLLED RAILWAY CAR SUPPORT POST

TECHNICAL FIELD OF THE INVENTION

The present invention relates generally to railcars and, more particularly, to a temperature controlled railway car support post.

BACKGROUND

Over the years, general purpose railway boxcars have progressed from relatively simple wooden structures mounted on flat cars to more elaborate arrangements including insulated walls and refrigeration equipment. Various types of insulated boxcars are presently manufactured and used. A typical insulated boxcar includes an enclosed structure mounted on a railway car underframe. The enclosed structure generally includes a floor assembly, a pair of side walls, a pair of end walls, a roof and various support posts. The side walls, end walls and roof often have an outer shell, one or more layers of insulation and interior paneling.

The American Association of Railroads (AAR) sets various design requirements for insulated and refrigerated railcars. One such requirements relates to a heat transmission value, $u_a$. The lower the $u_a$ value, then the less refrigeration needed for a refrigerated car. Thus, it is desirable to have a low a $u_a$ as possible for an insulated or refrigerated railcar. Much of the heat loss for such a railcar is through the side posts which are typically made of steel. The steel of the side posts is a much better conductor of heat than foam insulation used in the cars, so the heat transfer through these posts is large despite their smaller cross-sectional area. Fiber reinforced plastic (FRP) is typically used in the manufacture of many insulated and refrigerated railcars, such as for interior paneling.

SUMMARY

The present invention provides a railcar system and a method of manufacturing a railcar system that substantially eliminates or reduces at least some of the disadvantages and problems associated with previous railcar systems and methods.

In accordance with a particular embodiment, a railcar system includes a plurality of railcar walls and a plurality of railcar support posts each coupled to at least one of the plurality of walls. Each of the plurality of support posts comprises a web portion comprising a non-metallic material and a plurality of flange portions coupled to the web portion, the flange portions comprising a metallic material.

The non-metallic material may comprise fiber reinforced plastic or wood. The plurality of flange portions may each comprise a metal component forming an approximately ninety degree angle. The plurality of railcar support posts may each be welded to at least one of the plurality of walls. The plurality of flange portions may each be bonded to the web portion using glue or rivets. The plurality of flange portions may be configured to withstand bending forces imposed upon the support posts. A cross-section of each of the support posts may comprise a generally I-configuration.

In accordance with another embodiment, a method of manufacturing a railcar system includes coupling a plurality of flange portions to a plurality of web portions to form a plurality of railcar support posts. Each web portion comprises a non-metallic material, and each flange portion comprising a metallic material. The method includes coupling each of the plurality of railcar support posts to at least one of a plurality of railcar walls.

Technical advantages of particular embodiments of the present invention include a temperature controlled railcar support post with a web portion that comprises a non-metallic material. Thus, the web portion conducts less heat than the metal web portions of conventional support posts. Accordingly, an insulated or refrigerated railcar comprising the support post will lose less heat than conventional insulated or refrigerated railcars.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION

Figure 1:
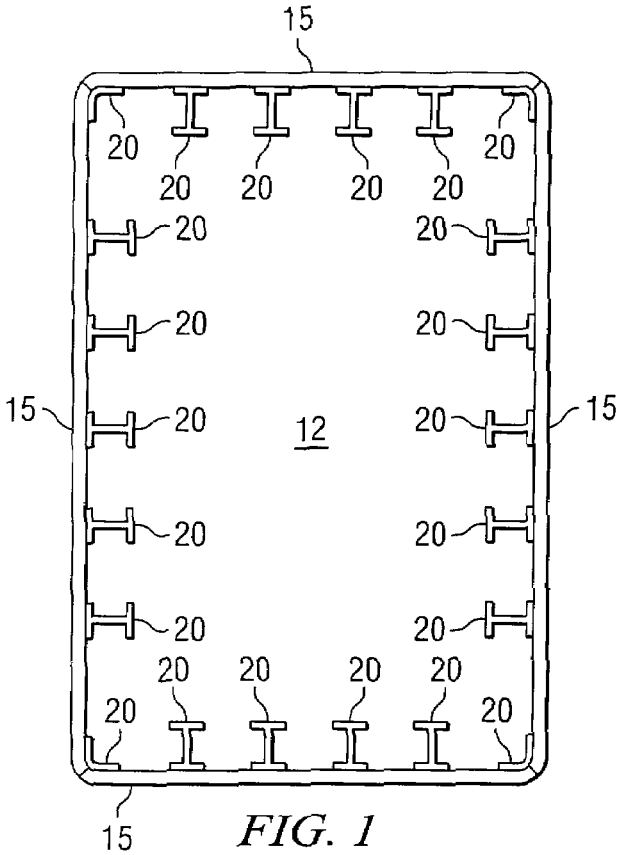
FIG. 1 is a schematic illustration of a plurality of support posts coupled to railcar walls, in accordance with a particular embodiment.

FIG. 1 is a schematic illustration of a plurality of support posts coupled to railcar walls, in accordance with a particular embodiment. Underframe 12 of a railcar is illustrated with a plurality of support posts 20 positioned thereon. Support posts 20 are each coupled to at least one railcar sidewall 15. Support posts 20 include posts of an I-beam configuration and posts of an L-beam configuration (e.g., in the corners of underframe 10). Other embodiments may include support posts having other configurations. Support posts 20 are configured to withstand shear forces and bending forces on the posts. For example, railcar lading may exert bending forces on the posts.

In some embodiments, support posts 20 may be utilized in an insulated railcar, such as one that may be refrigerated. Typical such support posts comprise steel in order to withstand forces applied during railcar operation. Particular embodiments provide a low heat-transfer (LHT) support post that can replace conventional steel posts without severely impacting the manufacturing process. In particular embodiments, support posts 20 may include non-steel portions, such as non-steel web portions, in order to reduce heat transfer in the post and therefore provide greater insulation for the railcar. In some cases, such non-steel portions may comprise fiber reinforced plastic (FRP). A support post made completely of FRP may not be practical because it may not match the stiffness of a conventional steel post and may allow excessive distortion of the side. In addition, it may have to be bonded to a railcar side sheet, and this would require a complete re-design of the railcar manufacturing process.

Figure 2:
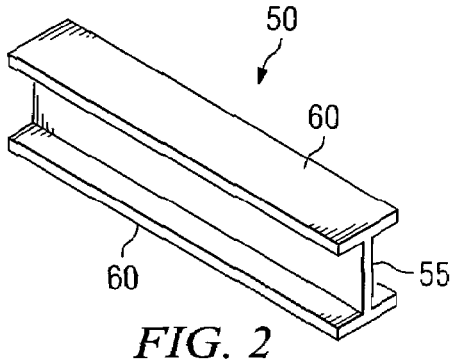
FIG. 2 illustrates a conventional support post for an insulated or refrigerated railcar.

FIG. 2 illustrates a conventional support post for an insulated or refrigerated railcar. Support post 50 is made completely out of steel or other metal and includes web portion 55 and flange portions 60. Web portion 55 typically carries shear forces on the post, and flange portions 60 typically carry bending forces on the post. When a railcar is in operation, the lading may lean against the side of the rail and may exert bending forces on the support posts. These bending forces may be resisted by longitudinal stresses in the flanges and may be greater in magnitude than the shear forces exerted on the posts and carried by the web portion. The metal composition of support post 50 conducts a fair amount of heat thus leading to heat loss from the railcar.

Figure 3A:
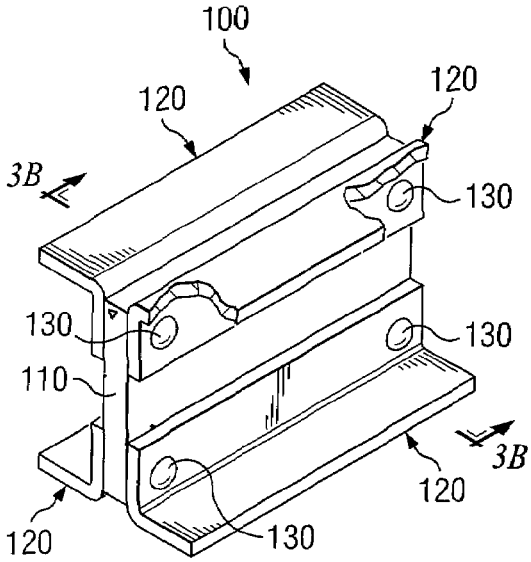
FIGS. 3A and 3B illustrate a support post for an insulated or refrigerated railcar, in accordance with a particular embodiment.
Figure 3B:
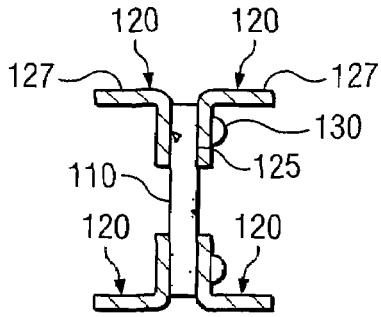

FIGS. 3A and 3B illustrate a support post for an insulated or refrigerated railcar, in accordance with a particular embodiment. Support post 100 includes a web portion 110 and metal angles 120. Metal angles 120 act as flange portions to withstand the bending forces imposed on the support post. Like flange portions of conventional support posts, metal angles 120 comprise steel or another strong metal. This enables the support post to withstand the bending forces imposed on the post, such as the bending forces imposed by the railcar lading.

Web portion 110 comprises FRP. Thus, web portion 110 conducts less heat than the metal web portions of conventional support posts. An insulated or refrigerated railcar comprising support post 100 with web portion 110 will therefore lose less heat than conventional insulated or refrigerated railcars with support posts having metal web portions. The railcar having one or more of support posts 100 will therefore also have a lower $u_a$ heat transfer value. While web portion 110 comprises FRP, web portions of railcars in other embodiments may include, in addition to FRP or in alternative to FRP, other non-metallic materials, such as other types of plastic or wood.

In the illustrated embodiment, web portion 110 is coupled to metal angles 120 through a bonding process. This bonding process may utilize an adhesive such as glue to couple web portion 110 to metal angles 120. Rivets 130 may be used to hold the web portion in place during the bonding process, for example, until the bonding glue sets. In some embodiments, the rivets may be removed after the bonding process is complete. Other embodiments may utilize other methods of coupling a web portion to a flange portion for a railcar, such as a bonding process using an adhesive such as glue.

An additional advantage to support posts described herein is that the bonding portion (e.g., portion 125 of FIG. 3B) is of a sufficient distance from a portion of the post used to weld the post to a railcar side sheet (e.g., welded portion 127). Thus, it is less likely that the welding process used to position the post in the railcar will damage the bonding between the web portion and the flange portion.

As discussed above, while particular embodiments are illustrated using support posts with I-beam configurations, support posts having other shapes and configurations and with non-metal web portions may be used.

Support posts in particular embodiments may have the same flexural stiffness as conventional posts and may thus replace conventional posts with minimal impact. In some cases, the $u_a$ value for an entire railcar with support posts described herein may improve 22 points or more.

Although the present invention has been described in detail with reference to particular embodiments, it should be understood that various other changes, substitutions, and alterations may be made hereto without departing from the spirit and scope of the present invention.

Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railcar system, comprising:

a plurality of railcar walls; and a plurality of railcar support posts each coupled to at least one of the plurality of walls, each of the plurality of support posts comprising:

a web portion comprising a non-metallic material, wherein the web portion comprises a flat plate; and a plurality of flange portions coupled to the web portion, the flange portions comprising a metallic material, wherein a first flange portion and a second flange portion are coupled to opposite ends of a first side of the web portion, a third flange portion and a fourth flange portion are coupled to opposite ends of a second side of the web portion, and wherein a middle portion of the first side is exposed between the first flange portion and the second flange portion, and a middle portion of the second side is exposed between the third flange portion and the fourth flange portion.

2. The railcar system of claim 1, wherein the non-metallic material comprises fiber reinforced plastic.

3. The railcar system of claim 1, wherein the non-metallic material comprises wood.

4. The railcar system of claim 1, wherein the plurality of flange portions each comprise a metal component forming an approximately ninety degree angle.

5. The railcar system of claim 1, wherein the plurality of railcar support posts are each welded to at least one of the plurality of walls.

6. The railcar system of claim 1, wherein the plurality of flange portions are each bonded to the web portion.

7. The railcar system of claim 6, wherein the plurality of flange portions are bonded to the web portion using glue.

8. The railcar system of claim 6, wherein the plurality of flange portions are bonded to the web portion using rivets.

9. The railcar system of claim 1, wherein the plurality of flange portions are configured to withstand bending forces imposed upon the support posts.

10. The railcar system of claim 1, wherein a cross-section of each of the support posts comprises a generally I-configuration.

11. A railcar support post, comprising:

a web portion comprising a non-metallic material, wherein the web portion comprises a flat plate; and a plurality of flange portions coupled to the web portion, the flange portions comprising a metallic material, wherein a first flange portion and a second flange portion are coupled to opposite ends of a first side of the web portion, a third flange portion and a fourth flange portion are coupled to opposite ends of a second side of the web portion, and wherein a middle portion of the first side is exposed between the first flange portion and the second flange portion, and a middle portion of the second side is exposed between the third flange portion and the fourth flange portion.

12. The support post of claim 11, wherein the non-metallic material comprises fiber reinforced plastic.

13. The support post of claim 11, wherein the non-metallic material comprises wood.

14. The support post of claim 11, wherein the plurality of flange portions each comprise a metal component forming an approximately ninety degree angle.

15. The support post of claim 11, wherein the plurality of flange portions are each bonded to the web portion.

16. The support post of claim 11, wherein the plurality of flange portions are configured to withstand bending forces imposed upon the support post.

17. The support post of claim 11, wherein a cross-section of the support post comprises a generally I-configuration.

18. A method of manufacturing a railcar system, comprising:

coupling a plurality of flange portions to a plurality of web portions to form a plurality of railcar support posts, each web portion comprising a non-metallic material, wherein each web portion comprises a flat plate, and each flange portion comprising a metallic material, wherein coupling a plurality of flange portions comprises coupling a first flange portion and a second flange portion to opposite ends of a first side of the web portion, and coupling a third flange portion and a fourth flange portion to opposite ends of a second side of the web portion, and wherein a middle portion of the first side is exposed between the first flange portion and the second flange portion, and a middle portion of the second side is exposed between the third flange portion and the fourth flange portion; and coupling each of the plurality of railcar support posts to at least one of a plurality of railcar walls.

19. The method of claim 18, wherein the non-metallic material comprises fiber reinforced plastic.

20. The method of claim 18, wherein the non-metallic material comprises wood.

21. The method of claim 18, wherein the plurality of flange portions each comprise a metal component forming an approximately ninety degree angle.

22. The method of claim 18, wherein coupling each of the plurality of railcar support posts to at least one of a plurality of railcar walls comprises welding each of the plurality of railcar support posts to at least one of the plurality of walls.

23. The method of claim 18, wherein coupling a plurality of flange portions to a plurality of web portions to form a plurality of railcar support posts comprises bonding a plurality of flange portions to a web portion to form each of the railcar support posts.

24. The method of claim 23, wherein the plurality of flange portions are bonded to the web portion using glue.

25. The method of claim 23, wherein the plurality of flange portions are bonded to the web portion using rivets.

26. The method of claim 18, wherein the plurality of flange portions are configured to withstand bending forces imposed upon the support posts.

27. The method of claim 18, wherein a cross-section of each of the support posts comprises a generally I-configuration.

28. A railcar system, comprising:

a plurality of railcar walls; and a plurality of railcar support posts wherein each of the plurality of supports is welded to at least one of the plurality of walls at a welding point, wherein a cross-section of each of the support posts comprises a generally I-configuration, and wherein each of the plurality of support posts comprises:

a web portion comprising a non-metallic material, wherein the nonmetallic material comprises at least one of fiber reinforced plastic and wood; and a plurality of flange portions coupled to the web portion, the flange portions comprising a metallic material, wherein a first flange portion and a second flange portion are coupled to opposite ends of a first side of the web portion, a third flange portion and a fourth flange portion are coupled to opposite ends of a second side of the web portion, and wherein a middle portion of the first side is exposed between the first flange portion and the second flange portion, and a middle portion of the second side is exposed between the third flange portion and the fourth flange portion, and wherein:

the plurality of flange portions each comprise a metal component forming an approximately ninety degree angle;

the plurality of flange portions are each fixedly bonded to the web portion at one or more bonding points using glue, and wherein each of the one or more bonding points are separated from the welding point;

the plurality of flange portions are each bonded to the web portion with one or more rivets during a glue bonding process and wherein the one or more rivets are removed after the plurality of flange portions are bonded to the web portion using glue; and the plurality of flange portions are configured to withstand bending forces imposed upon the support posts.

29. A railcar support post, comprising:

a web portion comprising a non-metallic material, the non-metallic material comprising at least one of fiber reinforced plastic and wood, and wherein the web portion comprises a flat plate; and a plurality of flange portions coupled to the web portion, the flange portions comprising a metallic material, wherein a first flange portion and a second flange portion are coupled to opposite ends of a first side of the web portion, a third flange portion and a fourth flange portion are coupled to opposite ends of a second side of the web portion, and wherein a middle portion of the first side is exposed between the first flange portion and the second flange portion, and a middle portion of the second side is exposed between the third flange portion and the fourth flange portion, and wherein:

the plurality of flange portions each comprise a metal component forming an approximately ninety degree angle;

the plurality of flange portions are each fixedly bonded to the web portion at one or more bonding points using glue, and wherein each of the one or more bonding points are separated from a welding point to a railcar wall;

the plurality of flange portions are each bonded to the web portion with one or more rivets during a glue bonding process and wherein the one or more rivets are removed after the plurality of flange portions are fixedly bonded to the web portion using glue; and the plurality of flange portions are configured to withstand bending forces imposed upon the support post; and wherein a cross-section of the support post comprises a generally I-configuration.

* * * * *